US007167674B2

(12) United States Patent
Hattori

(10) Patent No.: US 7,167,674 B2
(45) Date of Patent: Jan. 23, 2007

(54) SHEET STORAGE CASSETTE AND IMAGE FORMING APPARATUS

(75) Inventor: Makoto Hattori, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/288,120

(22) Filed: Nov. 29, 2005

(65) Prior Publication Data

US 2006/0115308 A1 Jun. 1, 2006

(30) Foreign Application Priority Data

Nov. 30, 2004 (JP) ..... 2004-347641

(51) Int. Cl.
*G03G 15/00* (2006.01)
*B41J 11/58* (2006.01)
*B65H 1/00* (2006.01)

(52) U.S. Cl. ..... 399/390; 400/624; 400/625; 400/628; 400/629; 271/145; 271/147; 271/162

(58) Field of Classification Search ..... 399/390; 400/624, 625, 628, 629; 271/145, 147, 162
See application file for complete search history.

(56) References Cited

U.S. PATENT DOCUMENTS 6,994,483 B2 * 2/2006 Jang ..... 400/629
2003/0223801 A1 * 12/2003 Jang ..... 400/718

FOREIGN PATENT DOCUMENTS

| | | |
|---|---|---|
| JP | A 62-104778 | 5/1987 |
| JP | U 5-10854 | 2/1993 |
| JP | A 8-333037 | 12/1996 |
| JP | A 11-315891 | 11/1999 |
| JP | A 2001-194924 | 7/2001 |

* cited by examiner

*Primary Examiner*—Daniel J. Colilla
*Assistant Examiner*—Marvin P. Crenshaw
(74) *Attorney, Agent, or Firm*—Oliff & Berridge, PLC

(57) ABSTRACT

A sheet storage cassette includes: a case provided with a storage portion; a stacking plate on which a sheet is placed; and a lifting unit that lifts the stacking plate. The lifting unit has: a driving gear that communicates with an output gear of the device main body in a state where the sheet storage cassette is received in the device main body, is rotated by driving force transmitted from the output gear, and is provided with an engaged part; a swing portion that has an engaging part engaged with the engaged part, and lifts the stacking plate by a rotation of the driving gear; and a reverse rotation allowing unit that allows the driving gear to rotate in an opposite direction to a direction of lifting the stacking plate when inserting the sheet storage cassette into the device main body.

11 Claims, 8 Drawing Sheets

SHEET STORAGE CASSETTE AND IMAGE FORMING APPARATUS

CROSS REFERENCE TO RELATED APPLICATION

This application claims priority from Japanese Patent Application No. 2004-347641, filed on Nov. 30, 2004, the entire subject matter of which is incorporated herein by reference.

TECHNICAL FIELD

Aspects of present invention relate to a sheet storage cassette and an image forming apparatus having the same, and more particularly, to a gear coupling structure between a device main body and the sheet storage cassette.

BACKGROUND

For example, in a printer, a paper feed cassette for storing papers is detachably mounted to a printer main body. The paper feed cassette includes a driving gear, which is coupled with an output gear of a device main body at the time of being mounted to the printer main body so as to push up a stacking plate on which sheets are stacked, and a pushing up member that lifts the stacking plate from below by the rotation of the driving gear fixed to an end of a rotating shaft of the driving gear. In this case, a driving force of the output gear is transmitted to the driving gear when starting the image forming operation of the printer, and thus the stacking plate is lifted so that the uppermost paper is lifted to a position at which a paper can be fed by a paper feeder of the printer main body.

Here, since the paper feed cassette is attached and detached, the driving gear is coupled with and is released from the output gear of the main body in each case. For this reason, when the paper feed cassette is mounted to the printer main body, the tooth tips of the output gear and the driving gear interfere with each other. Accordingly, the teeth of both gears do not smoothly engage with each other. A technology for smoothly engaging the gears with each other is disclosed in JP-UM-A-5-10854. In the technology, since each of the tooth tips of a gear mounted to a cover is made to be pointed at the end, the cover is smoothly opened and closed.

SUMMARY

Although the technology disclosed in JP-UM-A-5-10854 is applied to the paper feed cassette, one of the gears is compulsorily rotated to avoid the interference between the tooth tips of the output gear and the driving gear at the time of attaching or detaching the paper feed cassette. Because the output gear is coupled with the motor of the printer main body, in general, the driving gear is compulsorily rotated. For example, if the stacking plate is positioned at the lowest position and the driving gear applies force in the rotational direction when lowering the stacking plate, strong twist force is applied to the rotating shaft of the driving gear. Whenever the papers are replenished, the paper feed cassette is attached or detached. Accordingly, load is frequently applied to the rotating shaft, causing the life span of the rotating shaft or the driving gear to be reduced.

Aspects of the invention provided a sheet storage cassette capable of managing the load at the time of being received in a device main body, and smoothly coupling with the gears and an image forming apparatus having the same.

According to an aspect of the invention, there is provided a sheet storage cassette configured to be received in a device main body, to which a sheets is fed, in a manner that the sheet storage cassette can be pulled out of the device main body, the sheet storage cassette including: a case provided with a storage portion that stores the sheet; a stacking plate on which the sheet is placed, the stacking plate being capable of ascending and descending with respect to a bottom surface of the storage portion; and a lifting unit that lifts the stacking plate, wherein the lifting unit includes: a driving gear that communicates with an output gear of the device main body in a state where the sheet storage cassette is received in the device main body, is rotated by driving force transmitted from the output gear, and is provided with an engaged part; a swing portion that has an engaging part engaged with the engaged part, and lifts the stacking plate by a rotation of the driving gear; and a reverse rotation allowing unit that allows the driving gear to rotate in an opposite direction to a direction of lifting the stacking plate when inserting the sheet storage cassette into the device main body (at the time of coupling the output gear and the driving gear).

Incidentally, the "sheet" may be, for example, a paper or OPH sheet serving as a recording medium, and may be a paper money.

In addition, the 'sheet storage cassette' is not limited to a cassette for feeding a sheet to a main body of an image forming apparatus (such as a printer, a facsimile, or a multifunction device having functions of a printer and scanner and the like), and may be a cassette, for example, installed in a device for counting a sheet such as a paper money. Further, although the cassette can be pulled out of the device main body, the cassette may be separated from or may not be separated from the device main body.

In the above-mentioned structure, for example, when the sheet storage cassette is pulled out of the device main body, the engagement between the output gear of the device main body and the input gear (which is not limited to the driving gear and may be a gear between the output gear and the driving gear) of the sheet storage cassette is released. Accordingly, the stacking plate is deformed to the lowest position close to the bottom of the storage portion. That is, the stacking plate cannot move downward any further. When the sheet storage cassette is inserted into the device main body up to the receiving position, the tooth tips of the output gear and the gear of the sheet storage cassette interfere with each other. In this case, even though the gears are compulsorily rotated in the rotational direction when lowering the stacking plate, the driving gear is allowed to be rotated by a reverse rotation allowing unit. Therefore, load applied to the driving gear is reduced, as a result, it is possible to control the reduction of the life span thereof.

BRIEF DESCRIPTION OF THE DRAWINGS

Illustrative aspects of the invention may be more readily described with reference to the accompanying drawings.

DETAILED DESCRIPTION

Hereinafter, an embodiment of the invention will be described with reference to FIGS. 1 to 8.

1. The Entire Construction of the Embodiment

Figure 1:
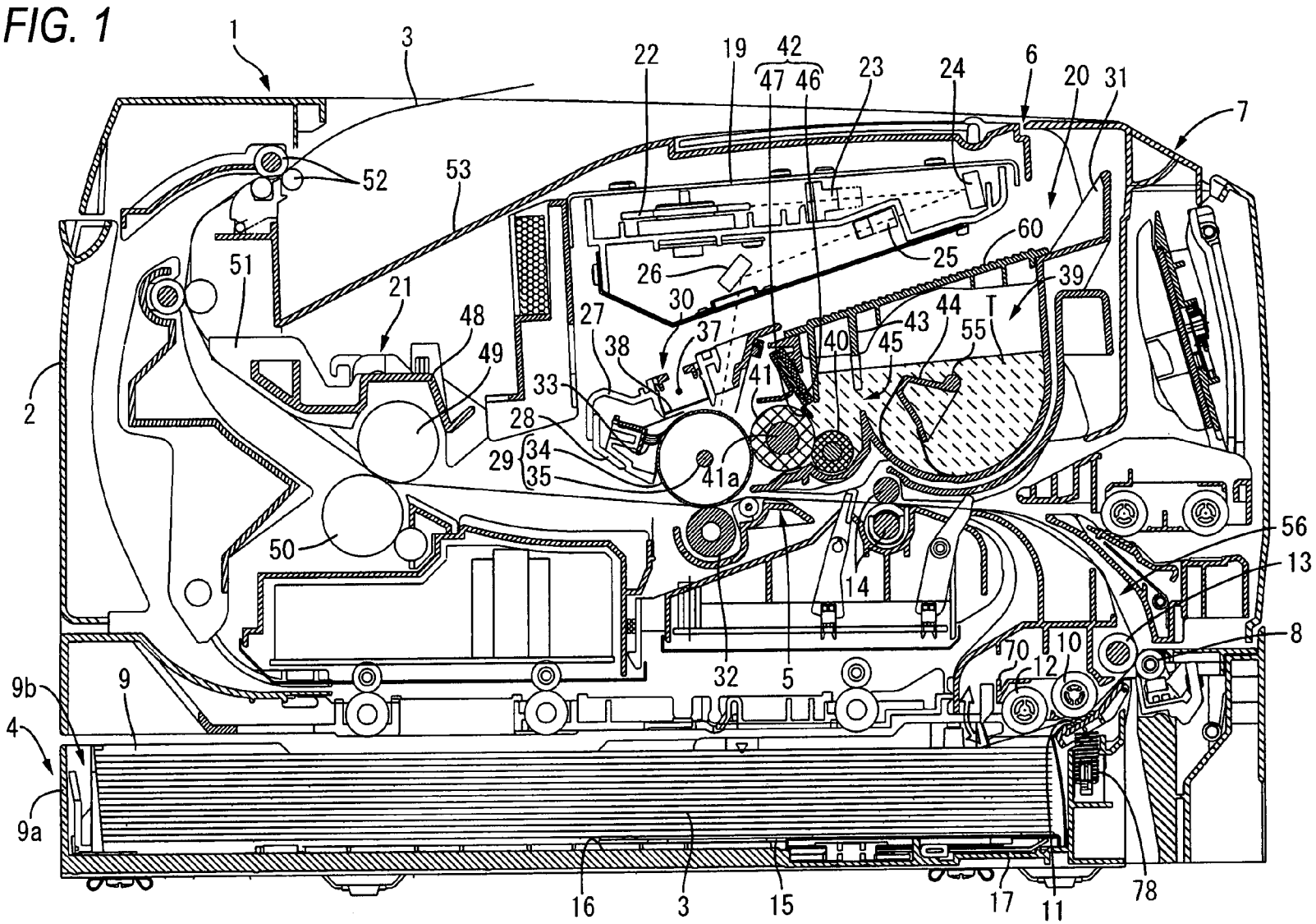
FIG. 1 is a side cross-sectional view showing main parts of a laser printer according to an embodiment of the invention.
Figure 2:
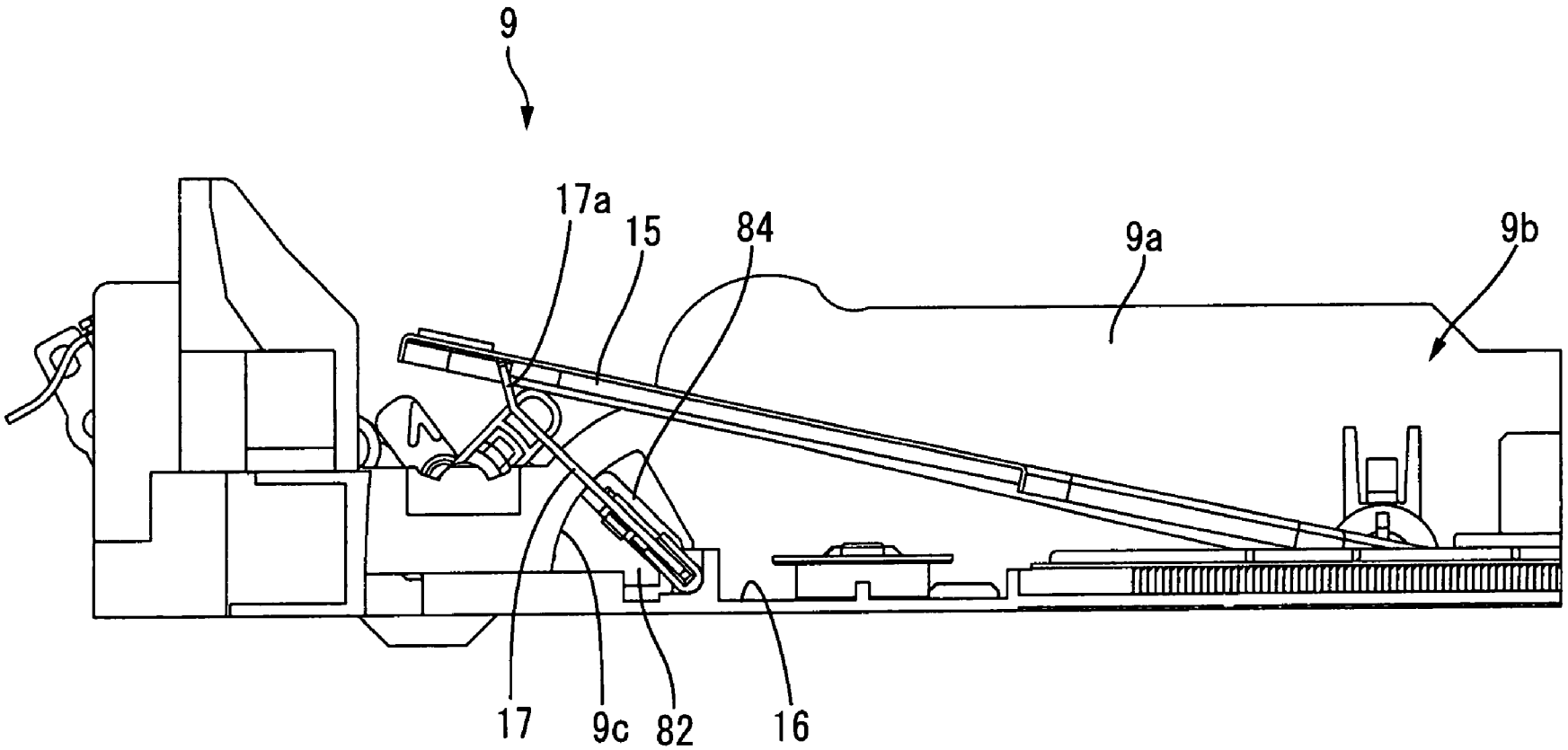
FIG. 2 is a side cross-sectional view showing main parts of a paper feed cassette.

FIG. 1 is a side cross-sectional view showing main parts of a laser printer as an image forming apparatus according to an embodiment of the invention. FIG. 2 is a side cross-sectional view showing main parts of a paper feed cassette 9 as seen from the opposite side, shown in FIG. 1. The laser printer 1 includes a main body casing 2, a feeder unit 4 which is received in the main body casing 2 and feeds a paper 3 as a sheet, an image forming unit 5 for forming an image on the fed paper 3.

(1) Main Body Casing

An attaching/detaching opening 6, through which a process cartridge 20 to be described below is attached and detached, and a front cover 7 for opening and closing the attaching/detaching opening 6 are provided on one wall of the main body casing 2. The front cover 7 is rotatably supported by a cover shaft (not shown), which is inserted into the lower end thereof. Accordingly, as shown in FIG. 1, when the front cover 7 is rotated about the cover shaft in one direction, the attaching/detaching opening 6 is closed by the front cover 7. When the front cover 7 is rotated about the cover shaft serving as a fulcrum in the other direction, the attaching/detaching opening 6 is opened. Accordingly, the process cartridge 20 can be attached to or detached from the main body casing 2 through the attaching/detaching opening 6.

In the following description, in a state in which the process cartridge 20 is mounted in the main body casing 2, a side where the front cover 7 is provided is referred to as a 'front side' and the opposite side thereto is referred to as a 'rear side'.

(2) Feeder Unit

In the lower portion of the main body casing 2, a feeder unit 4 is provided with a paper feed cassette 9 (a sheet storage cassette) which is mounted to be pulled out, a separation roller 10 and a separation pad 11 which are provided on the upper side of the front end portion of the paper feed cassette 9, and a paper feed roller 12 which is provided on the rear side (the upstream side of the separation pad 11 in the conveying direction) of the separation roller 10. Further, the feeder portion 4 is provided with a paper powder removing roller 8 which is disposed at the front upper side (the downstream side of the separation roller in the conveying direction of the paper 3 of the separation roller 10 so as to be opposite thereto, and a counter roller 13 which is disposed to be opposite to the paper powder removing roller 8. The separation roller 10, the separation pad 11, and the paper feed roller 12, the paper powder removing roller 8 and the counter roller 13 function as a conveying unit.

A conveying path 56 of the paper 3 is bent backward in a U shape near the paper powder removing roller 8, and a pair of registration rollers 14 are provided on the lower side of the process cartridge 20 at the downstream side of the conveying direction.

The paper feed cassette 9 includes a paper urging plate 15 (a stacking plate), on which the papers 3 can be placed in a stacked manner, in the inside 9*b* of the cassette case 9*a* which is formed as a whole in a flat box shape, with an upper surface thereof opened. A rear end portion of the paper urging plate 15 is swingably supported so that a front end portion thereof is swingable from the stacking position (a state shown in FIG. 1) to the supply position (a state shown in FIG. 2). In the stacking position, the front end portion thereof is disposed on the lower side so that the paper urging plate is placed along the bottom surface 16 of the cassette case 9*a* and, in the supply position, the front end portion is disposed on the upper side so that the paper urging plate is inclined.

In addition, a pushing up member 17 (a swing portion), which comes in contact with the lower surface of the paper urging plate 15 so as to push up the paper urging plate 15, is provided at the front end portion of the paper feed cassette 9. The pushing up member 17 is swingably supported at the lower position of the front end portion of the paper urging plate 15 so as to be swingable between the lying-down posture (a state shown in FIG. 1), where the front end portion lies down on the bottom surface 16 of the paper feed cassette 9, and the inclined posture (FIG. 2) where the front end portion lifts the paper urging plate 15. When a driving force is applied to the pushing up member 17 from the device main body 1*a*, the pushing up member 17 is rotated in the counter-clockwise direction in FIG. 1. Then, the front end portion of the pushing up member 17 pushes up the front end portion of the paper urging plate 15 so that the paper urging plate 15 is moved to the supply position.

When the paper urging plate 15 is positioned in the supply position, the paper 3 on the paper urging plate 15 is pressed against the paper feed roller 12, and the paper starts to be fed toward the separation position between the separation roller 10 and the separation pad 11 by the rotation of the paper feed roller 12.

In the meantime, when the paper feed cassette 9 is pulled out of the main body casing 2, the front end portion of the paper urging plate 15 is moved downward to be positioned in the stacking position so that the pushing up member 17 is in a lying-down posture. When the paper urging plate 15 is positioned in the stacking position, the papers 3 can be placed in a stacked manner on the paper urging plate 15. The separation pad 11, the paper powder removing roller 8, the paper urging plate 15, and the pushing up member 17 are provided in the paper feed cassette 9, and the paper feed roller 12, the separation roller 10, the counter roller 13, and the registration rollers 14 are provided in the main body casing 2. Incidentally, the portion of the laser printer 1, excluding the paper cassette 9, corresponds to a device main body 1*a* of the laser printer 1.

The papers 3 which are delivered toward the separation position by the paper feed roller 12 are separated one-by-one so as to be fed by the rotation of the separation roller 10, while being interposed in the separation position between the separation roller 10 and the separation pad 11. The fed paper 3 is bent along the U-shaped conveying path 56. More specifically, the fed paper 3 first passes through the separation position between the separation roller 10 and the separation pad 11 to be conveyed upward. Further, the paper 3 passes between the paper powder removing roller 8 and the counter roller 13, while paper powder is removed here. Then, the paper 3 is fed into the registration rollers 14.

In addition, the paper feed roller 12 and the separation roller 10 are rotatably supported by a bearing member 70 in a state in which rotating shafts thereof are provided parallel to each other in the direction orthogonal to the conveying path 56. A separation roller gear (not shown) is rotated by the driving force transmitted from the device main body 1*a*, and thus the separation roller 10 is dependently rotated.

Furthermore, a portion of the bearing member 70, which is on the side of paper feed roller 12, swings about the rotating shaft of the separation roller 10 (the direction indicated by an outline arrow of FIG. 1). The paper urging plate 15 is lifted by the rotation of the pushing up member 17, and thus the surface of the uppermost paper 3 of the papers, which are stacked on the paper urging plate 15, comes in contact with the paper feed roller 12 to reach the supply position. At this time, the transmission of the driving force is stopped, and the paper is controlled to be positioned on the paper urging plate 15 in the supply position.

After the registration of the paper 3, the registration rollers 14 convey the paper 3 to the transfer position, where a toner image on a photosensitive drum 29 is transferred onto the paper 3, between the photosensitive drum 29 and a transfer roller 32 to be described below.

(3) Image Forming Unit

The image forming unit 5 is provided with a scanner portion 19, a process cartridge 20, and a fixing portion 21.

(a) Scanner Portion

The scanner portion 19 is provided at the upper portion in the main body casing 2, and is provided with a laser light source (not shown), a polygon mirror 22 that is rotationally driven, an fθ lens 23, a reflecting mirror 24, a lens 25, and a reflecting mirror 26. As shown by the chained line, a laser beam based on image data to be emitted from the laser light source is deflected by the polygon mirror 22 to pass through the fθ lens 23. Then, the laser beam is reflected by the reflecting mirror 24 and passes through the lens 25. Further, the laser beam is refracted downward by the reflecting mirror 26, and then irradiated on the surface of the photosensitive drum 29 of the process cartridge 20 to be described below.

(b) Process Cartridge

The process cartridge 20 is detachably mounted with respect to the main body casing 2 on the lower side of the scanner portion 19. The process cartridge 20 is provided with an upper frame 27 and a lower frame 28 which is formed separately from the upper frame 27 and combined with the upper frame 27, as a case. In addition, the process cartridge 20 is provided with the photosensitive drum 29 serving as an image carrying unit, a scorotron-type charger 30 serving as a charging unit, a developing cartridge 31, a transfer roller 32 as a transferring unit, and a cleaning brush 33 inside the case.

The photosensitive drum 29, which is formed in a cylindrical shape, is provided with a drum main body 34, which is formed of positively-charged photosensitive layers of which the uppermost layer is made of polycarbonate, and a metallic drum shaft 35 serving as a shaft which extends along the longitudinal direction of the drum main body 34 in the center of the axis of the drum main body 34. The drum shaft 35 is supported by the upper frame 27 and the drum main body 34 is supported to rotate about the drum shaft 35, so that the photosensitive drum 29 is provided to rotate about the drum shaft 35 in the upper frame 27.

The scorotron-type charger 30, which is supported by the upper frame 27, is disposed at a predetermined interval so as not to come in contact with the photosensitive drum 29 and but to be opposite to the photosensitive drum 29 in the rearward-oblique and upper side of the photosensitive drum 29. The scorotron-type charger 30 is provided with a discharge wire 37, which is disposed at a predetermined interval to be opposite to the photosensitive drum 29, and a grid 38 which is provided between the discharge wire 37 and the photosensitive drum 29 to control an amount of discharge from the discharge wire 37 to the photosensitive drum 29. By the scorotron-type charger 30, a bias voltage is applied to the grid 38, and a high voltage is applied to the discharge wire 37 at the same time. Then, the discharge wire 37 is corona-discharged, so that the surface of the photosensitive drum 29 can be uniformly and positively charged.

The developing cartridge 31 is provided with a box-shaped housing case 60, of which the rear side is opened, and is detachably mounted with respect to the lower frame 28. Inside the developing cartridge 31, a toner containing chamber 39, a toner supply roller 40, a developing roller 41, and a thickness regulating blade 42 are provided.

The toner containing chamber 39 forms an inner space in the front side of the housing case 60, which is partitioned by a partitioning plate 43. The toner containing chamber 39 is filled with non-magnetic mono-component positive polymerization toner T as developer. Polymerized toner is used as the toner T. The polymerized toner is obtained by copolymerizing polymeric monomer, for example, styrene-based monomer such as styrene, or acrylic-based monomer, such as acrylic acid, alkyl (C1 to C4) acrylate, alkyl (C1 to C4) meta acrylate through the suspension polymerization method. Since the polymerized toner is formed in a substantially spherical shape, the fluidity thereof is very excellent. Accordingly, it is possible to form an image with a high definition.

In addition, coloring agent such as carbon black or wax is mixed in the toner, and silica is added to the toner in order to improve the fluidity. The average particle diameter of the toner is in the range of about 6 to 10 μm.

In addition, inside the toner containing chamber 39, an agitator 44 is provided, which is supported by a rotating shaft 55 provided in the center thereof. The agitator 44 is rotationally driven by the input of power from a motor (not shown). When the agitator 44 is rotationally driven, the toner T within the toner containing chamber 39 is agitated to be discharged toward the toner supply roller 40 from an opening portion 45 which communicates in the front and rear direction on the lower side of the partitioning plate 43. Furthermore, window members (not shown) are provided on both left and right sidewalls of the housing case 60 so as to correspond to the toner containing chamber 39, respectively. Each of the window members is cleaned by a wiper, which is held in an agitator to interlock. Moreover, in the mainbody casing 2, a light emitting element (not shown) is provided outside of one window member and a light receiving element (not shown) is provided outside of the other window member. Detection light, which is emitted from the light emitting element and passes through the housing case 60, is detected by the light receiving element, and the presence of the toner T is discriminated on the basis of the output value.

The toner supply roller 40 is disposed in the rear side of the opening portion 45 so as to be rotatably supported by the developing cartridge 31. The toner supply roller 40 is formed by coating a metallic roller shaft with a roller made of a conductive foam material. The toner supply roller 40 is rotationally driven by the input of power from a motor (not shown).

The developing roller 41 is rotatably supported by the developing cartridge 31 at the rear side of the toner supply roller 40 in a state where the developing roller 41 comes in contact with the toner supply roller 40 so as to be pressed against the toner supply roller 40. In addition, the developing roller 41 comes in contact with the photosensitive drum 29 opposite thereto, in a state where the developing cartridge 31 is mounted on the lower frame 28. The developing roller 41 is formed by coating a metallic roller shaft 41*a* with a roller made of a conductive rubber material. Both end portions of the roller shaft 41*a* project outward in the width direction orthogonal to the front and back direction from the side surface of the developing cartridge 31 at the rear end portion of the developing cartridge 31. The roller of the developing roller 41 is formed by coating the urethane rubber or silicon rubber, which contains fluorine, on the surface of a roller main body made of conductive urethane rubber or silicon rubber, which contains carbon particles. A developing bias is applied to the developing roller 41 at the time of developing. In addition, the developing roller 41 is rotationally driven in the same direction as the toner supply roller 40 by the input of power from a motor (not shown).

The thickness regulating blade 42 is provided with a pressing portion 47, which is made of insulating silicon rubber and has a semi-circular cross section, at the leading end portion of the blade main body 46 made of a metallic plate spring. The thickness regulating blade 42 is supported at the upper side of the developing roller 41 by the developing cartridge 31, and the pressing portion 47 is pressed against the developing roller 41 by an elastic force of the blade main body 46.

The toner T discharged from the opening portion 45 is supplied to the developing roller 41 by the rotation of the toner supply roller 40. At this time, the toner T is positively friction-charged between the toner supply roller 40 and the developing roller 41. The toner T supplied onto the developing roller 41 enters between the pressing portion 47 of the thickness regulating blade 42 and the developing roller 41 with the rotation of the developing roller 41 so as to be conveyed as a thin layer having a certain thickness on the developing roller 41.

The transfer roller 32 is rotatably supported by the lower frame 28. In a state where the upper frame 27 and the lower frame 28 are combined, the transfer roller 32 comes in contact with the photosensitive drum 29 opposite thereto in the up and down direction and is disposed so as to form a nip between the photosensitive drum 29 and the transfer roller 32. The transfer roller 32 is formed by coating a metallic roller shaft 32*a* with a roller made of a conductive rubber material. A transfer bias is applied to the transfer roller 32 at the time of transferring. In addition, the transfer roller 32 is rotationally driven in the reverse direction to the photosensitive drum 29 by the input of power from a motor (not shown).

The cleaning brush 33 is mounted on the lower frame 28. In a state where the upper frame 27 and the lower frame 28 are combined with each other, the cleaning brush 33 is disposed so as to come in contact with the photosensitive drum 29 opposite thereto at the rear side of the photosensitive drum 29.

With the rotation of the photosensitive drum 29, first, the surface of the photosensitive drum 29 is uniformly and positively charged by the scorotron-type charger 30. Then, the surface is exposed by high-speed scanning of a laser beam from the scanner portion 19, so that an electrostatic latent image corresponding to an image to be formed is formed on the paper 3.

Next, by the rotation of the developing roller 41, the toner, which is carried on the developing roller 41 and positively charged, comes in contact with the photosensitive drum 29. At this time, the toner is supplied to an electrostatic latent image which is formed on the surface of the photosensitive drum 29, that is, an exposed portion, which is exposed to a laser beam so that an electric potential thereof falls down, on the surface of the photosensitive drum 29 which is uniformly and positively charged. Herewith, the electrostatic latent image of the photosensitive drum 29 is developed and, on the surface of the photosensitive drum 29, a toner image caused by the inversion developing is conveyed.

After that, as shown in FIG. 1, the toner image carried on the surface of the photosensitive drum 29 is transferred onto the paper 3 by the transfer bias applied to the transfer roller 32, while the paper 3 to be conveyed by the resist roller 14 passes through the transfer position between the photosensitive drum 29 and the transfer roller 32. The paper 3 on which the toner image is transferred is conveyed to the fixing portion 21.

In addition, remaining toner, which remains on the photosensitive drum 29 after the transference, is collected by the developing roller 41. Further, the paper powder, which is generated from the paper 3 attached on the photosensitive drum 29 after the transference, is collected by the cleaning brush 33.

(c) Fixing Portion

The fixing portion 21, which is provided in the rear side of the process cartridge 20, is provided with a fixing frame 48. Inside the fixing frame 48, a heating roller 49 and a pressing roller 50 are provided.

The heating roller 49 includes a metal tube of which surface is coated with fluorine resin, and a halogen lamp for heating which is provided in the metal tube. The heating roller 49 is rotationally driven by the input of power from a motor (not shown). In the mean time, the pressing roller 50 is disposed to press the heating roller 49 on the lower side of the heating roller 49. The pressing roller 50 is formed by coating a roller shaft made of metal with a roller made of rubber material, and is rotated by the rotation of the heating roller 49.

In the fixing portion 21, the toner transferred onto the paper 3 is thermally fixed at the transfer position, while the paper 3 passes between the heating roller 49 and the pressing roller 50. The paper 3 on which the toner is fixed is conveyed to a paper discharge path 51 which extends in the up and down direction toward the upper surface of the main body casing 2. The paper 3 conveyed to the paper discharge path 51 is discharged by a paper discharge roller 52 provided on the upper side thereof onto a paper discharge tray 53, which is formed on the upper surface of the main body casing 2.

2. A Lifting Unit for Pushing Up the Paper Urging Plate (1) Gear Mechanism

Figure 3:
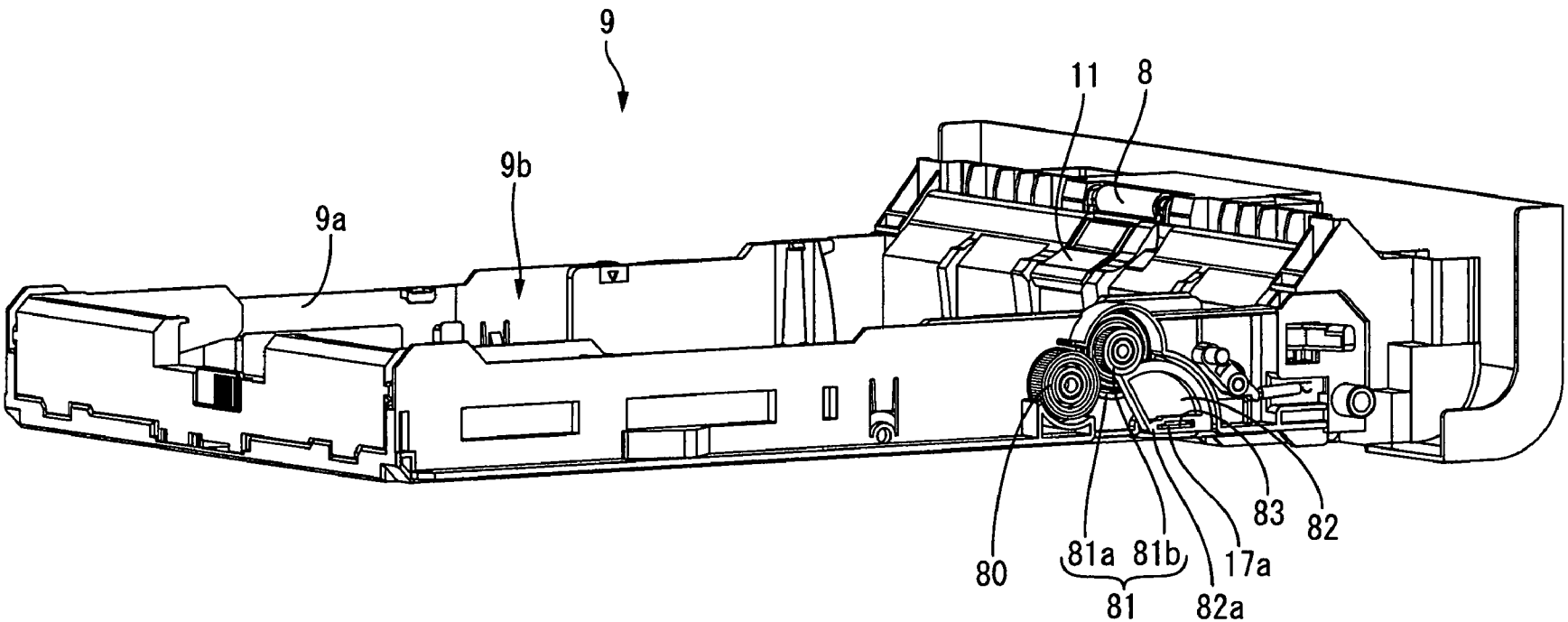
FIG. 3 is a perspective views showing the paper feed cassette.
Figure 4:
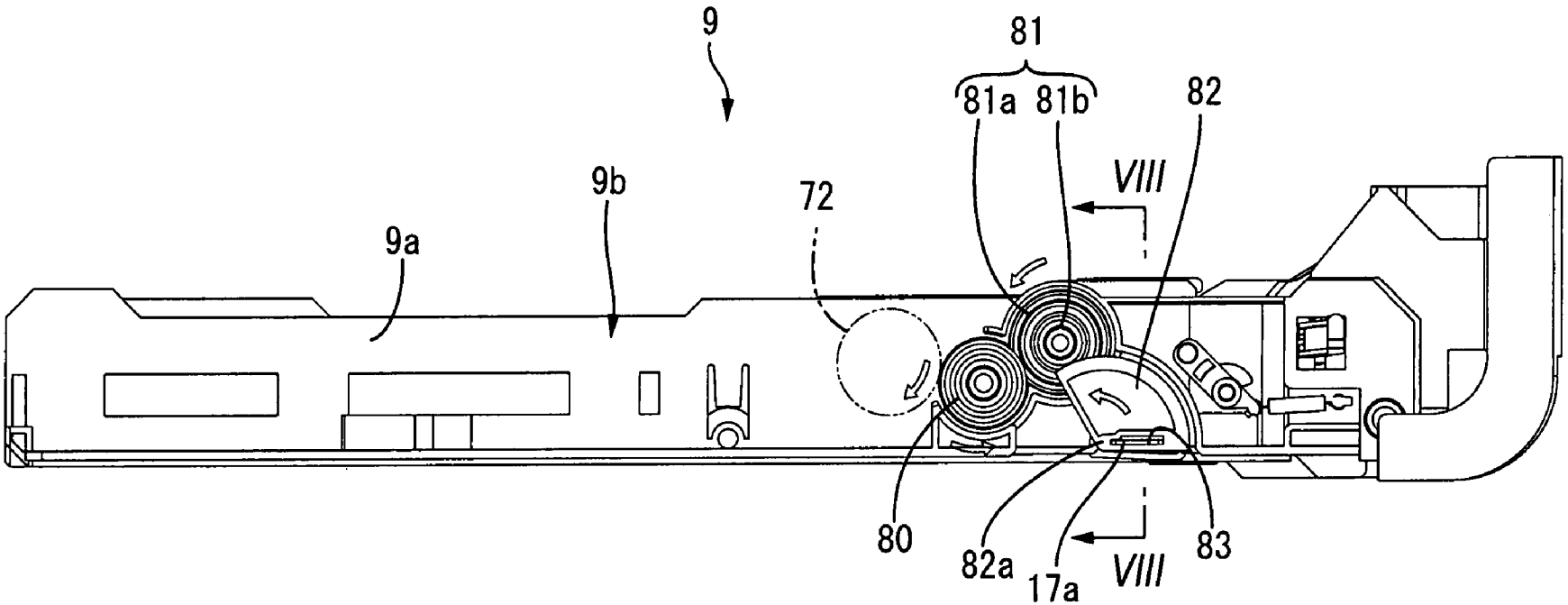
FIG. 4 is a side view showing the paper feed cassette.

FIG. 3 is a perspective view showing the paper feed cassette 9 as seen from the same side as that shown in FIG. 1, and FIG. 4 is a side view showing the paper feed cassette 9 as seen from the same side as that shown in FIG. 1. As shown in FIGS. 3 and 4, an input gear 80 engaged with an output gear 72 of the device mainbody lain a state where the paper feed cassette 9 is received in the device main body 1*a* (a state shown in FIG. 1), an intermediate gear 81 (reduction gear) engaged with the input gear 80, and a driving gear 82 are rotatably provided on a right sidewall of a cassette case 9*a*. The input gear 80 is a disk-shaped gear as a whole. The intermediate gear 81 has a disk-shaped main gear 81*a* engaged with the input gear 80, and a disk-shaped sub gear 81*b* having a smaller diameter than that of the main gear 81*a*. The main gear 81*a* and the sub gear 81*b* are integrally formed so as to be coaxial with each other. The driving gear 82 is formed in a fan shape as a whole, and is provided to be rotated about a center 82*a* thereof. Furthermore, teeth are formed on the circumferential surface of the circular arc portion of the driving gear 82, and the teeth are engaged with the sub gear 81*b* of the intermediate gear 81.

As shown in FIG. 4, in the state in which the paper feed cassette 9 is received in the device main body 1*a*, the output gear 72 and the input gear 80 are engaged with each other so that the output gear 72 is rotated in the clockwise direction in FIG. 4 by the driving force from a driving motor (not shown) provided in the device main body 1*a*. Accordingly, the input gear 80 is rotated in the counter-clockwise direction, and the intermediate gear 81 is rotated in the clockwise direction. Further, the driving gear 82 is also rotated in the counter-clockwise direction (in the direction of pushing up the paper urging plate 15, that is, the direction corresponding to the rotational direction of lifting the stacking portion). In addition, each of the gears 72, 80, 81, and 82 is made of, for example, a resin material.

(2) Structure to Assemble Driving Gear and Pushing Up Member

Figure 5:
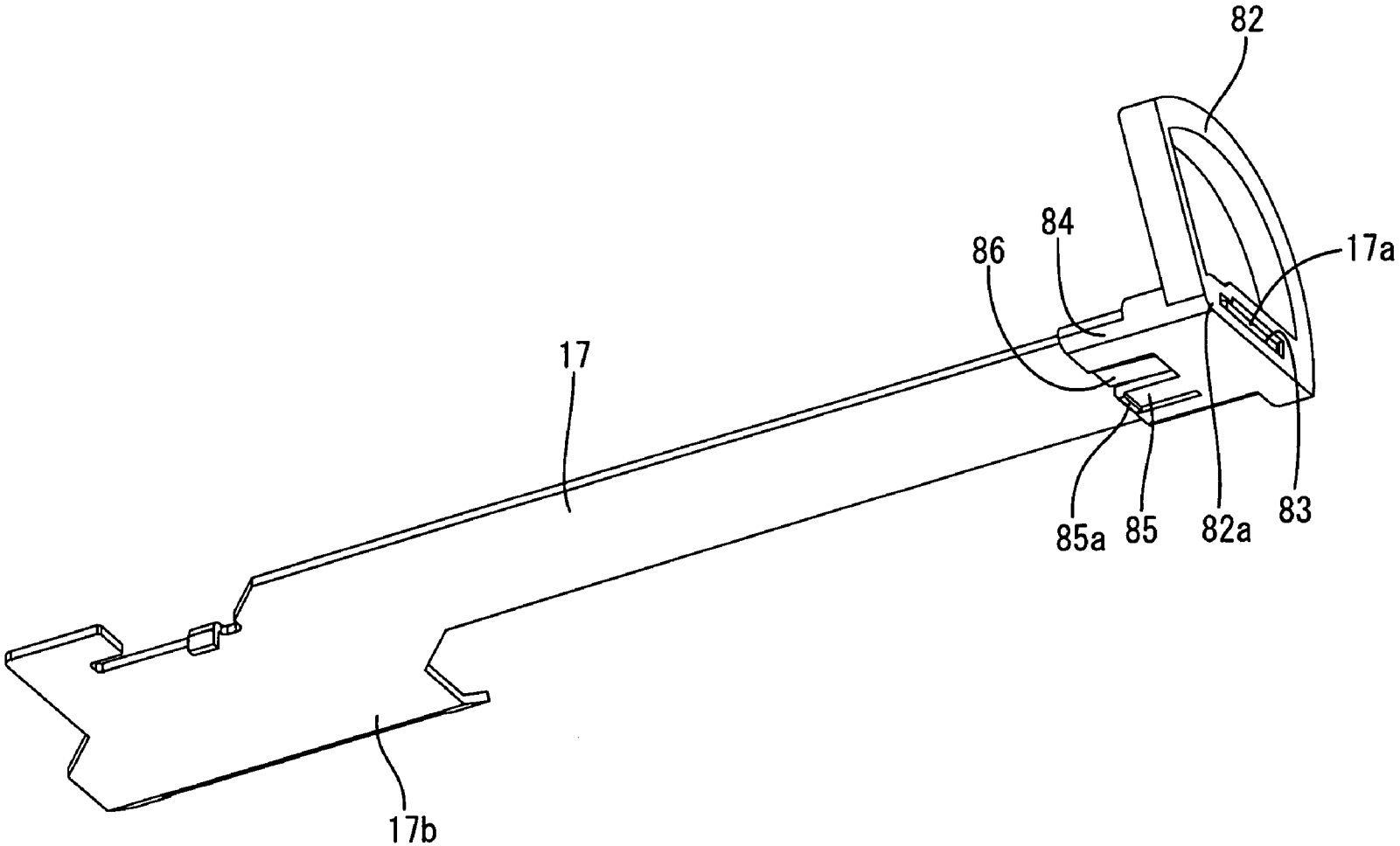
FIG. 5 is a perspective view showing a state in which a driving gear and a pushing up member are assembled to each other.
Figure 6:
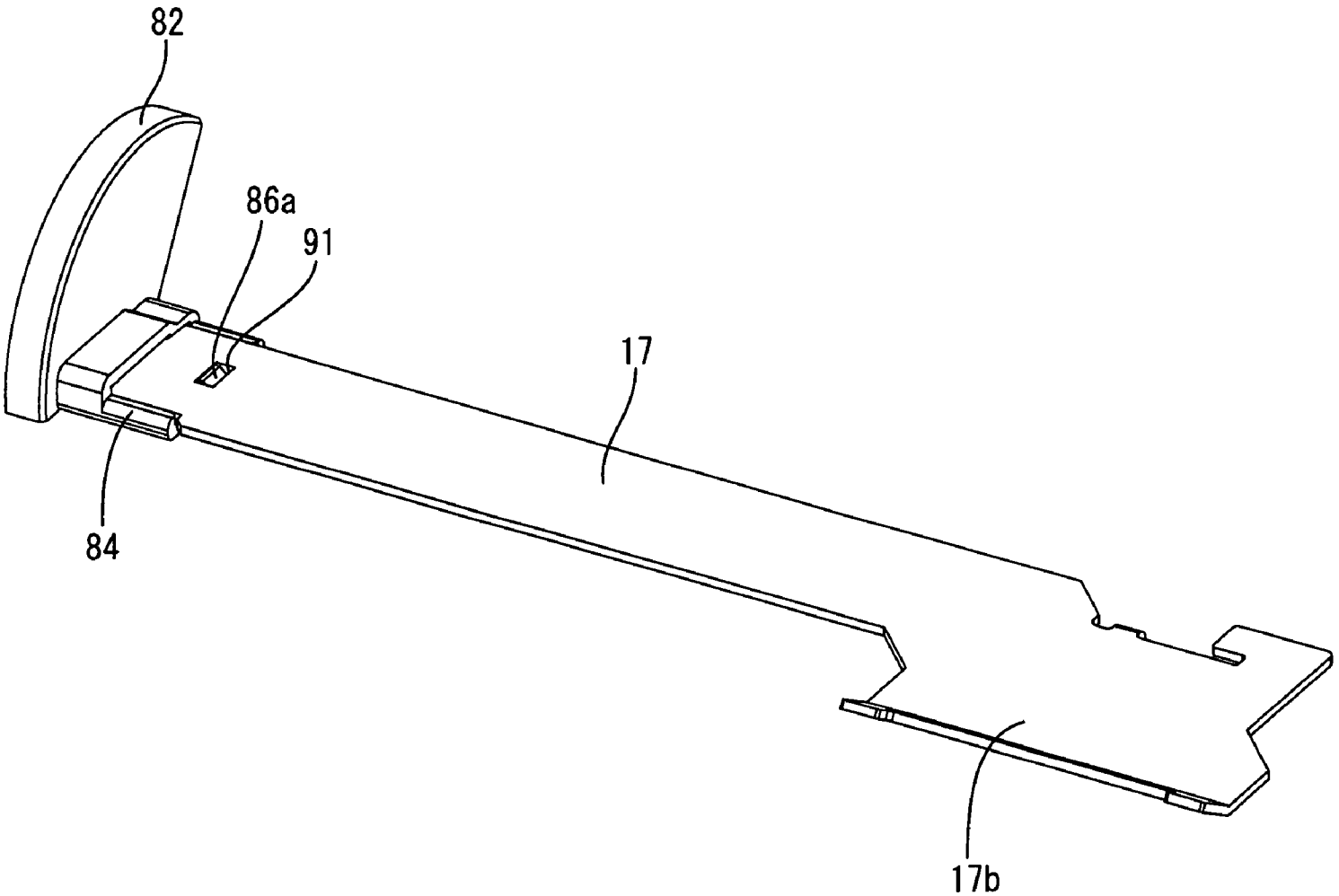
FIG. 6 is a perspective view showing a state in which the driving gear and the pushing up member are assembled to each other.

FIGS. 5 and 6 are perspective views showing a state in which the driving gear 82 and the pushing up member 17 are assembled to each other.

(a) Driving Gear

As shown in FIGS. 4 and 5, an engaged hole 83, which is formed in a slit shape in the radial direction, (corresponding to an engaged part) is formed on the driving gear 82 to pass therethrough on the rear side of the lifting direction of the pushing up member 17. In addition, the driving gear 82 is provided with a receiving part 84 protruding in the axial direction of the driving gear 82. The receiving part 84 is inserted into a fan-shaped insertion hole 9*c* (see FIG. 2), which is formed on the right sidewall of the cassette case 9*a* to pass therethrough and is continuous to the lower surface of the engaged hole 83. The receiving part 84 is integrally provided with a first elastic piece 85 (corresponding to an elastic protrusion or urging member) having a nail 85*a*, and a second elastic piece 86 (corresponding to a locking protrusion) having a nail 86*a*. The tip of the nail 85*a* is bent to protrude downward from the lower surface of the receiving part 84, and the tip of the nail 86*a* is bent to protrude upward from the upper surface of the receiving part 84. The first elastic piece 85 and the second elastic piece 86 are formed by notching or cutting the protruding end of the receiving part 84.

(b) Pushing Up Member

As shown in FIGS. 5 and 6, the pushing up member 17 is made of metal, and is a plate having an L shape. The pushing up member 17 is disposed on the bottom surface 16 of the cassette case 9*a* in the direction orthogonal to the pulling-out direction of the paper feed cassette 9. The tip 17*a* (corresponding to an engaging part) of the pushing up member 17 to be inserted into the insertion hole 9*c* is inserted into the engaged hole 83 of the driving gear 82. In addition, a locking recess 91 is formed on the pushing up member 17 to pass therethrough in the vicinity of the tip 17*a* thereof. In the state in which the driving gear 82 is assembled to the pushing up member 17, the nail 86*a* of the second elastic piece 86 is locked in the locking recess 91 from the lower surface of the pushing up member 17 in the lifting direction thereof. Accordingly, the driving gear 82 and the pushing up member 17 can be assembled to each other in the state in which the driving gear 82 and the pushing up member 17 are positioned in the direction of the rotation axis thereof.

In the mean time, a contact part 17*b* bent in an L shape, which is provided on the opposite side to the tip 17*a* in the pushing up member 17, comes in contact with the lower surface of the paper urging plate 15. Accordingly, as the pushing up member 17 is rotated by the driving gear 82, the lower surface of the paper urging plate 15 is lifted up by the contact part 17*b*.

In the state in which the paper feed cassette 9 is received in the device main body 1*a*, since the driving force from the output gear 72 is transmitted to the driving gear 82 through the input gear 80 and the intermediate gear 81 by the above-mentioned structure, the driving gear 82 is rotated. Then, when the pushing up member 17 is rotated so that the contact part 17*b* rises, the paper urging plate 15 is lifted from the stacking position shown in FIG. 1 to the supply position shown in FIG. 2. Therefore, the driving gear 82 and the pushing up member 17 function as a lifting unit.

(3) Reverse Rotation Allowing Unit

For example, as shown in FIG. 2, in the state in which the paper urging plate 15 is in the supply position, when the paper feed cassette 9 is pulled out of the device main body la so as to replenish papers, the engagement between the output gear 72 and the input gear 80 is released. Accordingly, the paper urging plate 15 moves down by its own weight so that the pushing up member 17 is rotated in the direction of a lying-down posture, and the input gear 80, intermediate gear 81 and the driving gear 82 are rotated in direction opposite to the rotational direction thereof at the time of pushing up operation of the pushing up member 17. Finally, the pushing up member 17 is in a lying-down posture and then the paper urging plate 15 returns to the stacking position.

Figure 7A:
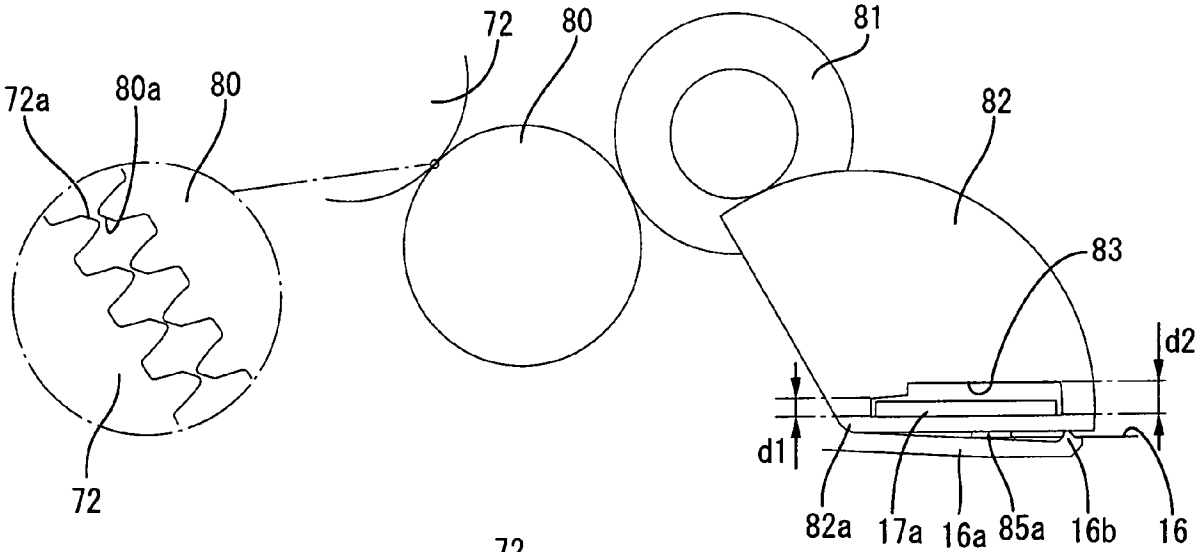
FIGS. 7A and 7B are views showing processes in which an output gear is engaged with an input gear.
Figure 7B:
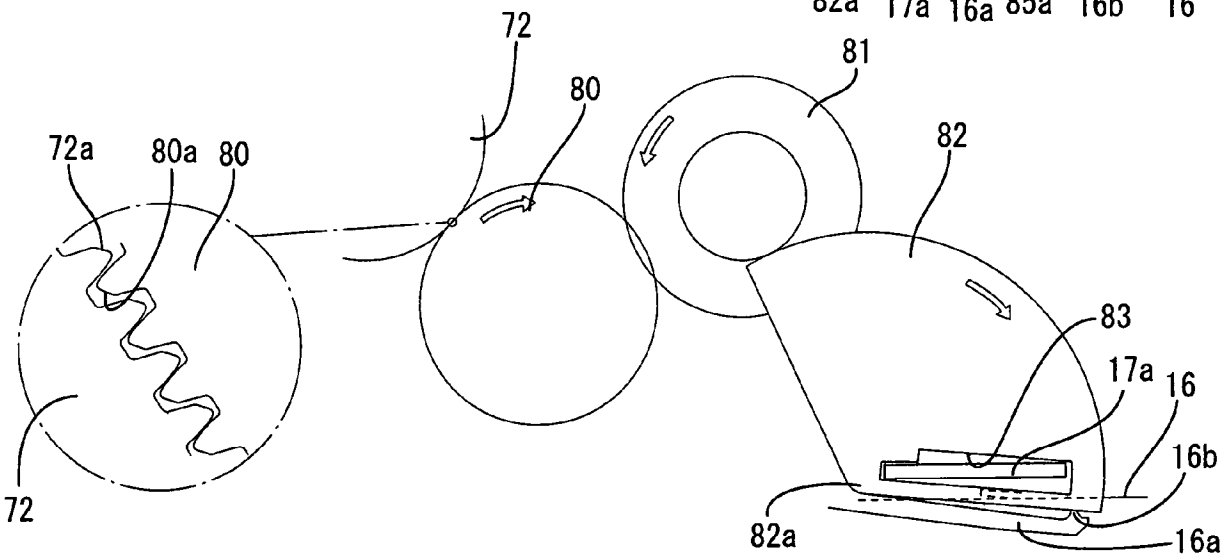
Figure 8:
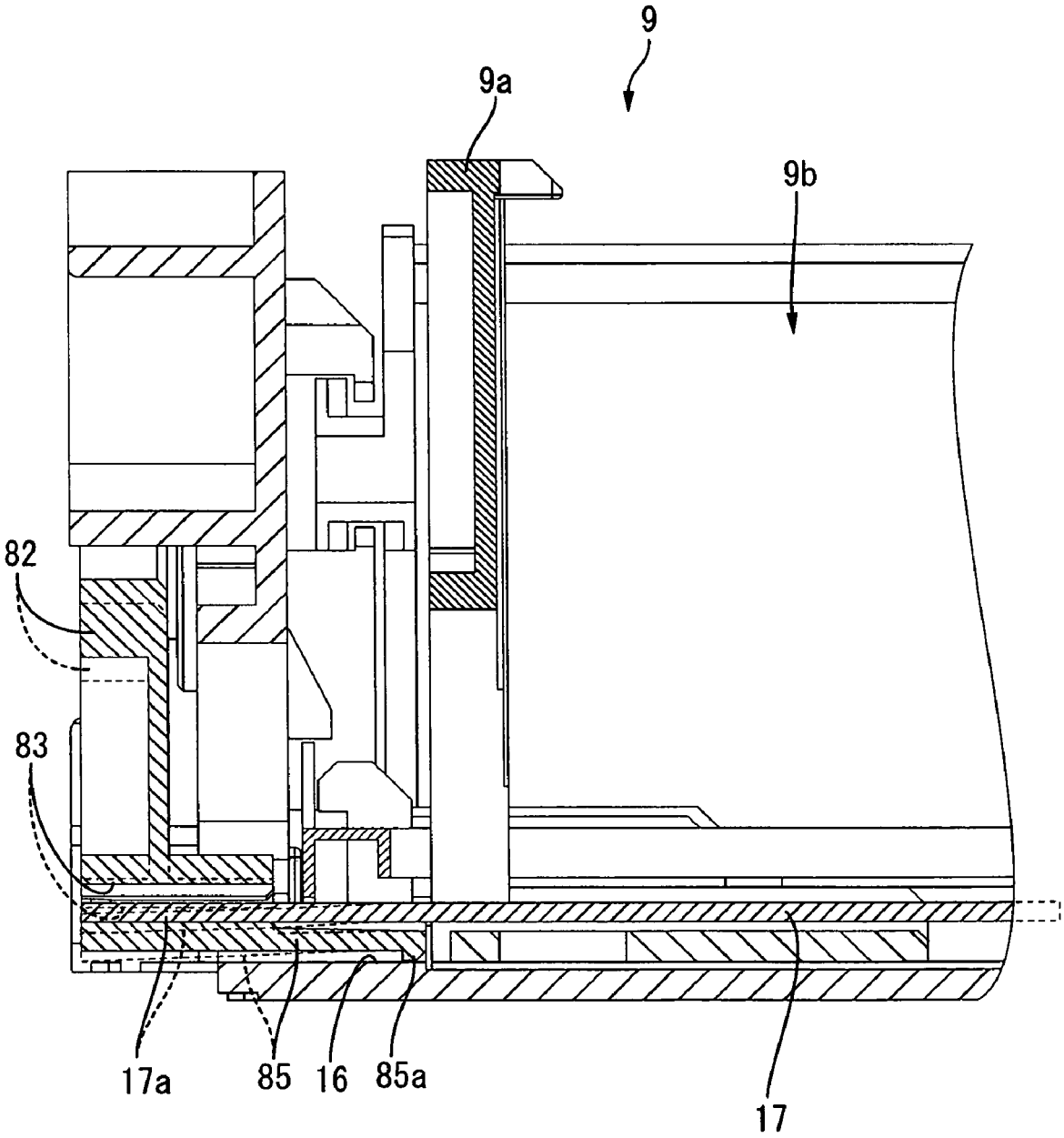
FIG. 8 is a cross-sectional view taken along line VIII—VIII of FIG. 4.

In the present embodiment, a reverse rotation allowing unit, which allows the input gear 80, intermediate gear 81 and the driving gear 82 to be rotated in direction opposite to the rotational direction thereof at the time of pushing up operation of the pushing up member 17, is provided in the above-mentioned structure. FIGS. 7A and 7B are views showing processes in which the output gear 72 is engaged with the input gear 80, and FIG. 8 is a cross-sectional view taken along line VIII—VIII of FIG. 4. In FIG. 8, chained lines show a state in which the first elastic piece 85 is elastically deformed.

Specifically, as shown in FIGS. 7A and 7B, the engaged hole 83 provided to the driving gear 82 has a width d2 on the outer circumferential side thereof on which the teeth are formed larger than a width d1 (a width larger than the thickness of the pushing up member 17) on the central side thereof. That is, the tip 17*a*. of the pushing up member 17 is engaged with the engaged hole 83 with a clearance in the rotational direction of the driving gear 82.

In the state in which the paper feed cassette 9 is pulled out of the device main body 1*a* and thus the engagement between the output gear 72 and the input gear 80 is released, as shown in FIGS. 7A and 8 (the portion shown by solid lines), the nail 85*a* of the first elastic piece 85 comes in contact with the bottom surface 16 of the cassette case 9*a* so that the lower surface of the device main body of the driving gear 82 stays away from the bottom surface 16. Accordingly, the driving gear 82 can be further rotated in the direction (the clockwise direction in FIG. 7) of pushing down the paper urging plate 15 from the released state, while elastically deforming the first elastic piece 85 (see the portion shown by chained lines in FIG. 8).

Furthermore, in the present embodiment, as shown in FIGS. 7A and 7B, a third elastic piece 16*a* elastically coming in contact with the lower surface of the driving gear 82 is also provided to the bottom surface 16. The third elastic piece 16*a* is elastically deformed to be tilted about the center 82*a* of the driving gear 82. A bent nail 16*b* of the third elastic piece 16*a* comes in contact with the lower surface of the driving gear 82.

(4) Shape of Tooth Tips of Output Gear and Input Gear

As shown in FIGS. 7A and 7B, a back surface of each of the tooth tips 72*a* of the output gear 72 in the rotational direction during the driving by the driving motor, that is, in the rotational direction (in the clockwise direction in FIGS. 7A and 7B) in which the paper urging plate 15 is pushed up is cut so that each of the teeth is pointed at the end. In other words, each of the tooth tips 72*a* has an inclined surface with respect to the radial direction of the output gear 72 so that a front side of the each tooth tip 72*a* protrudes further than a back side thereof in the pushing up rotational direction.

Correspondingly, a back surface of each of the tooth tips 80*a* of the input gear 80 in the rotational direction (in the clockwise direction in FIGS. 7A and 7B) in which the paper urging plate 15 is pushed up is cut so that each of the teeth is pointed at the end. In other words, each of the tooth tips 80*a* has an inclined surface with respect to the radial direction of the input gear 80 so that a front side of the each tooth-tip 80*a* protrudes further than a back side thereof in the pushing up rotational direction.

3. Effects of the Present Embodiment (1) As described above, in the state in which the paper feed cassette 9 is pulled out of the device main body 1*a*, the pushing up member 17 is in a lying-down posture and then the paper urging plate 15 returns to the stacking position. Accordingly, the pushing up member 17 comes in contact with the bottom surface 16 and thus cannot be tilted more downward than the lying-down posture. For this reason, the paper urging plate 15 cannot move more downward than the lying-down posture. When the paper feed cassette 9 is reloaded in the device main body 1*a*, the tooth tips 72*a* and 80*a* of the output gear 72 and the input gear 80 might interfere with each other as shown in FIG. 7A.

Here, in the present embodiment, the tip 17*a* of the pushing up member 17 is engaged with the engaged hole 83 with a clearance, and the driving gear 82 spaces away from the bottom surface 16 by the nail 85*a* of the first elastic piece 85. That is, even though the pushing up member 17 and the paper urging plate 15 cannot move downward any further, it is possible to rotate the driving gear 82, the intermediate gear 81, and the input gear 80 in the direction (the direction indicated by an outline arrow of FIG. 7B, corresponding to the opposite direction to the direction of lifting the stacking plate) in which the paper urging plate 15 is pushed down.

Accordingly, in the state in which the tooth tips 72*a* and 80*a* of the output gear 72 and the input gear 80 interfere with each other, when the paper feed cassette 9 is reinserted into the rear side of the device main body, the input gear 72 is rotated in the direction (the clockwise direction in FIG. 7B) in which the paper urging plate 15 is pushed up so that both the gears 72 and 80 are engaged with each other. For this reason, it is possible to reduce the load that is applied to each of the gears 80, 81, and 82 or rotating shafts thereof.

(2) In addition, in the state in which the paper feed cassette 9 is separated from the device main body 1*a*, the driving gear 82 is rotatably held by the first elastic piece 85 and the third elastic piece 16*a* serving as the urging members in the direction of lifting the paper urging plate 15. Therefore, when the paper feed cassette 9 is received in the device main body 1*a*, it is possible to always perform an operation for allowing the reverse rotation as shown in FIGS. 7A and 7B.

(3) Since each of the urging members is composed of an electric piece, the structure thereof can be made simpler than the structure using springs as the urging members. Furthermore, since the first elastic piece 85 is integrally formed with the driving gear 82 and the third elastic piece 16*a* is integrally formed with the bottom surface 16, it is possible to reduce the number of parts.

(4) In the state in which the driving gear 82 and the pushing up member 17 are assembled to each other, the nail 86*a* of the second elastic piece 86 is locked in the locking recess 91 from the lower surface of the pushing up member 17 in the lifting direction thereof. Accordingly, when the operation for allowing the reverse rotation is performed, the only driving gear 82 can be independently rotated with respect to the pushing up member 17 in the pushing down direction. In addition, at this time, an allowable rotational range of the driving gear 82 is sufficient to be one tooth of the input gear 72, and the nail 86*a* of the second elastic piece 86 has a predetermined length not to be completely separated from the locking recess 91 even after the performance of the operation for allowing the reverse rotation.

(5) The engaged hole 83 formed on the driving gear 82 has a width d2 on the outer circumferential side thereof larger than a width d1 (a width larger than the thickness of the pushing up member 17) on the central side thereof. Accordingly, it is possible to freely rotate the driving gear 82 about the center 82*a* thereof even during the performance of the operation for allowing the reverse rotation.

(6) Moreover, the back surface of each of the tooth tips 72*a* and 80*a* of the output gear 72 and the input gear 80 in the rotational direction when lifting the paper urging plate 15 is cut so that each of the teeth is pointed at the end. Therefore, it is possible to smoothly engage the output gear with the input gear so as to be guided along the inclined surface of each of the tooth tips 72*a* and 80*a*.

OTHER EMBODIMENTS

The invention is not limited to the embodiment that is described with reference to the drawings, and for example, the following embodiments are also included in the scope of the invention. Further, in addition to the following embodiments, the invention can be variously modified within the scope of the invention.

(1) In another structure of the reverse rotation allowing unit, for example, a clearance may be provided between the contact part 17*b* and the bottom surface 16 opposite thereto in the state in which the pushing up member 17 is in a lying-down posture. However, in the structure, since a rotational stroke of the contact part 17*b* is larger than that of the driving gear 82, it is necessary to increase the clearance. Considering the size-reduction of the device, the structure of the above-mentioned embodiment is preferable. In addition, it is also preferable that the structure of the embodiment and this modification be combined.

(2) As long as the tip 17*a* of the pushing up member 17 is formed in a plane shape capable of being inserted into the engaged hole 83, a portion of the pushing up member 17 other than the tip 17*a* may not be formed in a plane shape.

(3) Each of the engaged hole 83 and the locking recess 91 may be a hole having a bottom or a notched portion in addition to the through hole.

(4) The first elastic piece 85 and the third elastic piece 16*a* are elastic pieces serving as urging members. However, the first elastic piece 85 and the third elastic piece are not limited thereto, and may be composed of spring members or rubber members.

(5) Furthermore, although both the first elastic piece 85 and the third elastic piece 16*a* are provided in the structure of the embodiment, only one of the first elastic piece 85 and the third elastic piece 16*a* may be provided in the structure.

(6) The lifting unit is a member for pushing up the paper urging plate 15 from below. However, the lifting unit is not limited thereto, and may be a member for lifting the paper urging plate 15 from above.

What is claimed is:

1. A sheet storage cassette configured to be received in a device main body, to which a sheets is fed, in a manner that the sheet storage cassette can be pulled out of the device main body, the sheet storage cassette comprising:

a case provided with a storage portion that stores the sheet;

a stacking plate on which the sheet is placed, the stacking plate being capable of ascending and descending with respect to a bottom surface of the storage portion; and a lifting unit that lifts the stacking plate, wherein the lifting unit comprises:

a driving gear that communicates with an output gear of the device main body in a state where the sheet storage cassette is received in the device main body, is rotated by driving force transmitted from the output gear, and is provided with an engaged part;

a swing portion that has an engaging part engaged with the engaged part, and lifts the stacking plate by a rotation of the driving gear; and a reverse rotation allowing unit that allows the driving gear to rotate in an opposite direction to a direction of lifting the stacking plate when inserting the sheet storage cassette into the device main body.

2. The sheet storage cassette according to claim 1, wherein the engaged part is formed at a position separated from a rotation center of the driving gear, and is engaged with the engaging part with a clearance in a rotational direction of the driving gear, and the reverse rotation allowing unit comprises an urging member that urges the driving gear in the rotational direction of lifting the stacking plate in a state where the stacking plate is positioned at a lowest position.

3. The sheet storage cassette according to claim 2, wherein the urging member comprises an elastic protrusion protruding from the driving gear in a direction of a rotation axis of the driving gear, and the elastic protrusion elastically comes into contact with the bottom surface of the storage portion in the state where the stacking plate is positioned at the lowest position.

4. The sheet storage cassette according to claim 2, wherein the swing portion is provided with a locking recess on a back surface thereof, and the driving gear is provided with a locking protrusion having a tip thereof which is locked in the locking recess from the back side in the rotational direction of lifting the stacking plate.

5. The sheet storage cassette according to claim 1, wherein the engaging part is formed in a plate shape, and the engaged part is formed in the driving gear in an opening shape extending along a radial direction of the driving gear, and has a width on an outer circumferential side of the driving gear larger than a width on a central side of the driving gear.

6. The sheet storage cassette according to claim 1, wherein a back surface in the rotational direction when lifting the paper urging plate of each of tooth tips of a gear engaged with the output gear is cut so as to sharpen the tooth tips.

7. The sheet storage cassette according to claim 1, further comprising:

an input gear that communicates with the driving gear;

wherein the input gear couples with the output gear in a state where the sheet storage cassette is received in the device main body.

8. The sheet storage cassette according to claim 7, further comprising:

at least one intermediate gear that communicates with the input gear and the drive gear;

wherein the at least one intermediate gear transmits driving force from the input gear to the driving gear.

9. An image forming apparatus comprising:

a sheet storage cassette that is configured to be received in the image forming apparatus, to which a sheets is fed, in a manner that the sheet storage cassette can be pulled out of the image forming apparatus, the sheet storage cassette comprising:

a case provided with a storage portion that stores the sheet;

a stacking plate on which the sheet is placed, the stacking plate being capable of ascending and descending with respect to a bottom surface of the storage portion; and a lifting unit that lifts the stacking plate;

an output gear;

a conveying unit that conveys the sheet placed on the stacking plate of the sheet storage cassette; and an image forming unit that forms an image on the sheet fed by the conveying unit;

wherein the lifting unit comprises:

a driving gear that communicates with the output gear of the image forming apparatus in a state where the sheet storage cassette is received in the image forming apparatus, is rotated by driving force transmitted from the output gear, and is provided with an engaged part;

a swing portion that has an engaging part engaged with the engaged part, and lifts the stacking plate by a rotation of the driving gear; and a reverse rotation allowing unit that allows the driving gear to rotate in an opposite direction to a direction of lifting the stacking plate when inserting the sheet storage cassette into the image forming apparatus.

10. The image forming apparatus according to claim 9, wherein a back surface in the rotational direction when lifting the paper urging plate of each of tooth tips of the output gear is cut so as to sharpen the tooth tips.

11. An image forming apparatus comprising:

a sheet storage cassette that is configured to be received in the image forming apparatus, to which a sheets is fed, in a manner that the sheet storage cassette can be pulled out of the image forming apparatus, the sheet storage cassette comprising:

a case provided with a storage portion that stores the sheet;

a stacking plate on which the sheet is placed, the stacking plate being capable of ascending and descending with respect to a bottom surface of the storage portion; and a lifting unit that lifts the stacking plate;

an output gear;

a conveying unit that conveys the sheet placed on the stacking plate of the sheet storage cassette; and an image forming unit that forms an image on the sheet fed by the conveying unit;

wherein the lifting unit comprises:

a driving gear that communicates with the output gear of the image forming apparatus in a state where the sheet storage cassette is received in the image forming apparatus, is rotated by driving force transmitted from the output gear, and is provided with an engaged part;

an input gear that communicates with the driving gear;

at least one intermediate gear that communicates with the input gear and the driving gear;

a swing portion that has an engaging part engaged with the engaged part, and lifts the stacking plate by a rotation of the driving gear; and a reverse rotation allowing unit that allows the driving gear to rotate in an opposite direction to a direction of lifting the stacking plate when inserting the sheet storage cassette into the image forming apparatus; and wherein the input gear couples with the output gear in a state where the sheet storage cassette is received in the image forming apparatus, and the at least one intermediate gear transmits driving force from the input gear to the driving gear.

* * * * *